US006564974B1

(12) United States Patent
Manzke

(10) Patent No.: US 6,564,974 B1
(45) Date of Patent: May 20, 2003

(54) DISPENSER FOR LIQUIDS

(75) Inventor: Peter Manzke, Riedstadt (DE)

(73) Assignee: Merck Patentgesellschaft, Darmstadt (DE)

( * ) Notice: Subject to any disclaimer, the term of this patent is extended or adjusted under 35 U.S.C. 154(b) by 0 days.

(21) Appl. No.: 09/936,439

(22) PCT Filed: Mar. 7, 2000

(86) PCT No.: PCT/EP00/01968

§ 371 (c)(1),
(2), (4) Date: Dec. 19, 2001

(87) PCT Pub. No.: WO00/54635

PCT Pub. Date: Sep. 21, 2000

(30) Foreign Application Priority Data

Mar. 15, 1999 (DE) ..... 199 11 360

(51) Int. Cl.[7] ..... A47F 9/00
(52) U.S. Cl. ..... 222/182; 222/143
(58) Field of Search ..... 222/129, 129.1, 222/143, 173, 182, 183, 608, 609; 141/231

(56) References Cited

U.S. PATENT DOCUMENTS 3,843,020 A * 10/1974 Bardeau et al. ..... 137/408
5,190,188 A * 3/1993 Credle, Jr. ..... 222/1
5,788,090 A 8/1998 Kajiwara
5,833,096 A * 11/1998 Ohu ..... 141/231

FOREIGN PATENT DOCUMENTS

EP 0 319 348 A 6/1989
FR 2 336 905 A 7/1977

* cited by examiner

*Primary Examiner*—J. Casimer Jacyna
(74) *Attorney, Agent, or Firm*—Millen, White, Zelano & Branigan, P.C.

(57) ABSTRACT

A dispensing appliance for liquids consists of at least one cabinet-like supply module (1) and of a cabinet-like dispensing module (2) connected to the latter. A pull-out trolley (3) can be moved out of the front side of the supply module (1) and serves for receiving a supply container (8) which can be inserted through one of the two open side faces (6). The dispensing module has a dispensing space (17) accessible from the front side. The supply module (1) has a square plan contour with an edge length (a) which is equal to the depth (t) of the dispensing module (2) designed with a rectangular plan contour. The dispensing module (2) can be connected selectively to each of the three side faces (11, 18, 19) of the supply module (1).

18 Claims, 3 Drawing Sheets

Figure 1:
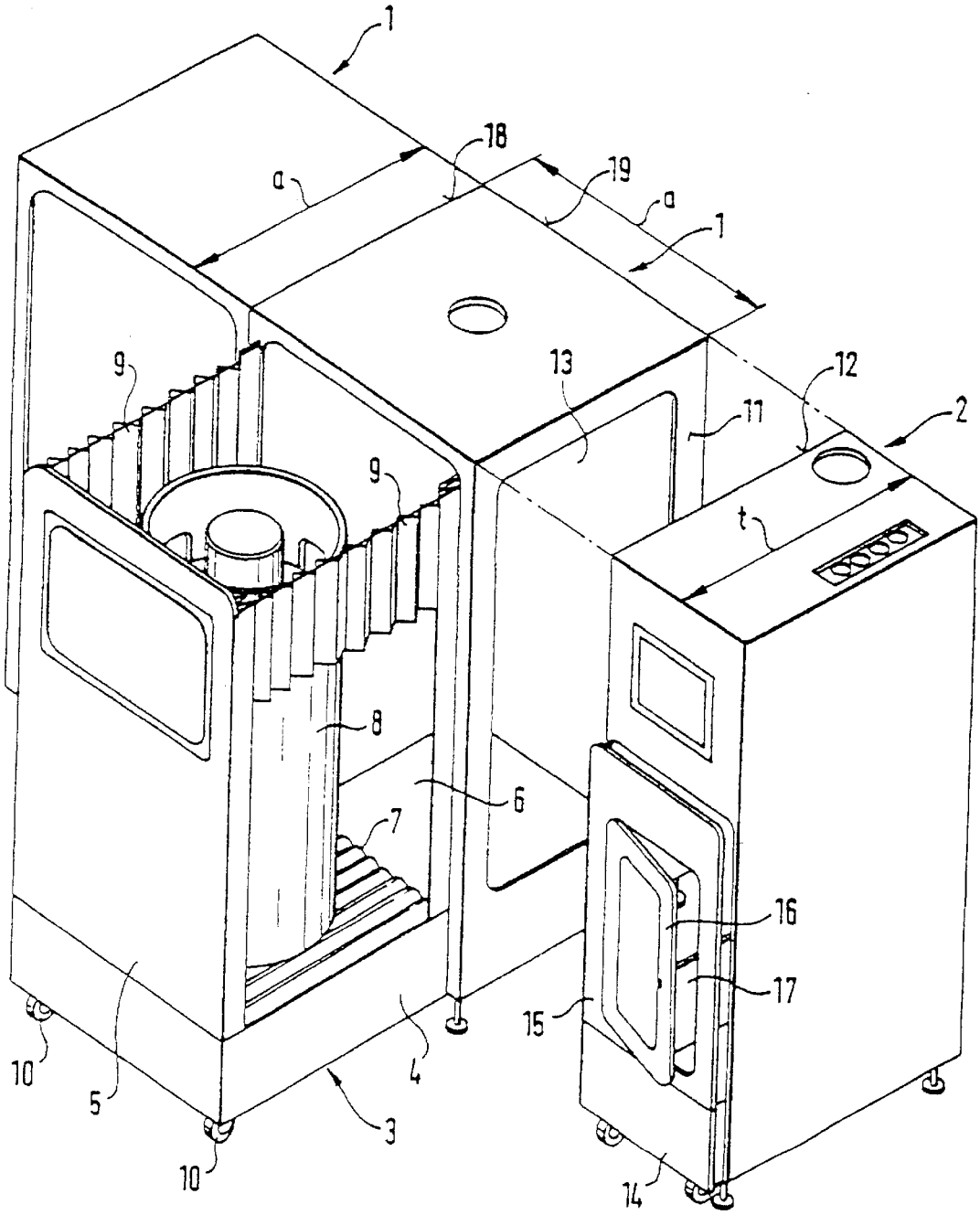

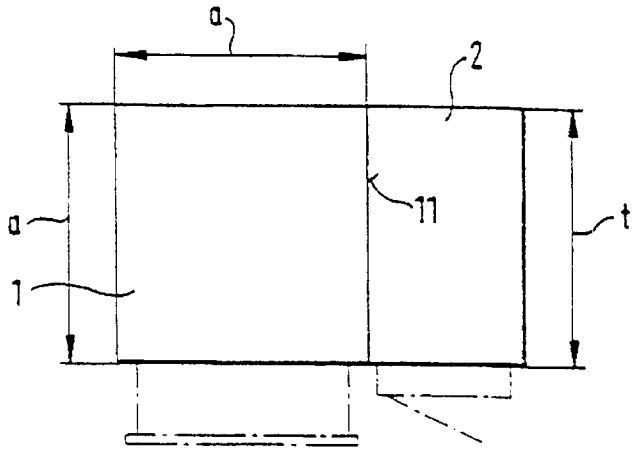
FIG. 2a
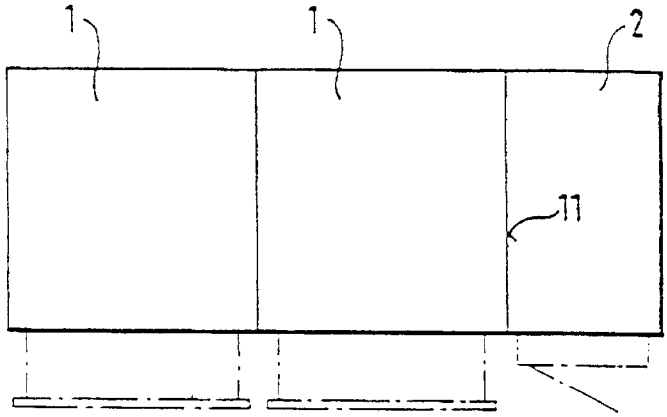
FIG. 2b
FIG. 2c
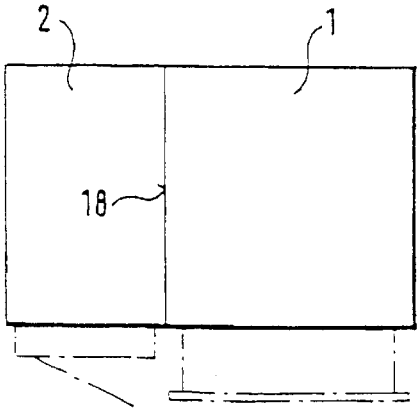
FIG. 2d
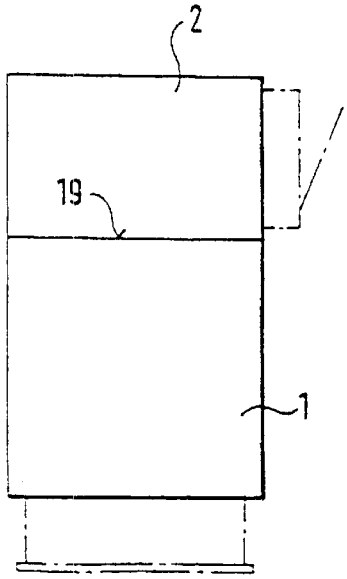

DISPENSER FOR LIQUIDS

The invention relates to a dispensing appliance for liquids, in particular chemicals, pharmaceutical raw materials and similar media, which should not come into contact with the outside atmosphere, for example biological media. These liquids are conventionally delivered in a supply container designed as a drum or the like and in each case have to be dispensed in relatively small quantities at the consumer's, for example in a semiconductor factory. Dispensing normally takes place in bottles or in the production section. The liquid is conveyed either by feeding an inert gas at excess pressure into the supply container or by means of a pump.

Known dispensing appliances are designed as cabinet-like units which have both a receiving space for the supply container and the installations and metering devices necessary for dispensing. The setting-up of a plurality of such dispensing appliances required for dispensing different liquids necessitates a relatively large setting-up area. Particularly in semiconductor factories and research laboratories, however, the setting-up area is restricted and/or costly.

The object of the invention is, therefore, to design a dispensing appliance of the generic type mentioned, in such a way that high flexibility as regards the setting-up possibilities, particularly with a view to loading, is achieved, so that, even in the case of different available setting-up areas, in each case a space-saving set-up becomes possible.

This object is achieved, according to the invention, by means of a dispensing appliance for liquids, consisting of at least one cabinet-like supply module and of a cabinet-like dispensing module connectable to the latter and having a dispensing space accessible from the front side, the supply module having a square plan contour with an edge length which is equal to the depth of the dispensing module designed with a rectangular plan contour.

Dividing the dispensing appliance into a supply module and a dispensing module and adapting the edge length of the square plan contour of the supply module to the depth of the rectangular dispensing module make it possible in each case to connect the supply module to the dispensing module, with a view to the loading possibility, in such a way that the available space is utilized optimally. This applies, in particular, when a plurality of dispensing appliances of this type normally have to be set up in a room, the plan area of which is to be utilized optimally. The modular design also makes it possible to set up the supply modules in a delivery store and to set up the dispensing modules in a separate setting-up room.

Depending on the set task predetermined by the organizational or production flow, it is possible to combine the supply module with the dispensing module in a flexible way, so that, even if there is only a little space available, a provisioning system for all the different liquids required can be implemented.

Preferably, a pull-out trolley intended for the exchangeable reception of a supply container can be moved out of the front side of the supply module.

According to a preferred embodiment, there is provision for the pull-out trolley of the supply module to have a base trough which is connected to a front plate, and for at least one of the two side faces of the pull-out trolley to be open. Lateral loading of the pull-out trolley becomes possible as a result. The utilization of space is particularly flexible if both side faces of the pull-out trolley are open, so that it can be loaded selectively from one side or the other, depending on the arrangement and accessibility of the dispensing appliance.

The division according to the invention of the dispensing appliance into at least one supply module and a dispensing module also makes it possible to connect the dispensing module together with two supply modules in each case. As a result, in each case a second supply container can be made ready before the first supply container is emptied completely, so that, after the first supply container has been emptied, a change-over to the second full supply container becomes possible in a simple way. The exchange of the emptied supply container can then be carried out at a later time.

Other advantageous refinements of the concept the invention are the subject-matter of further subclaims.

Figure 3:
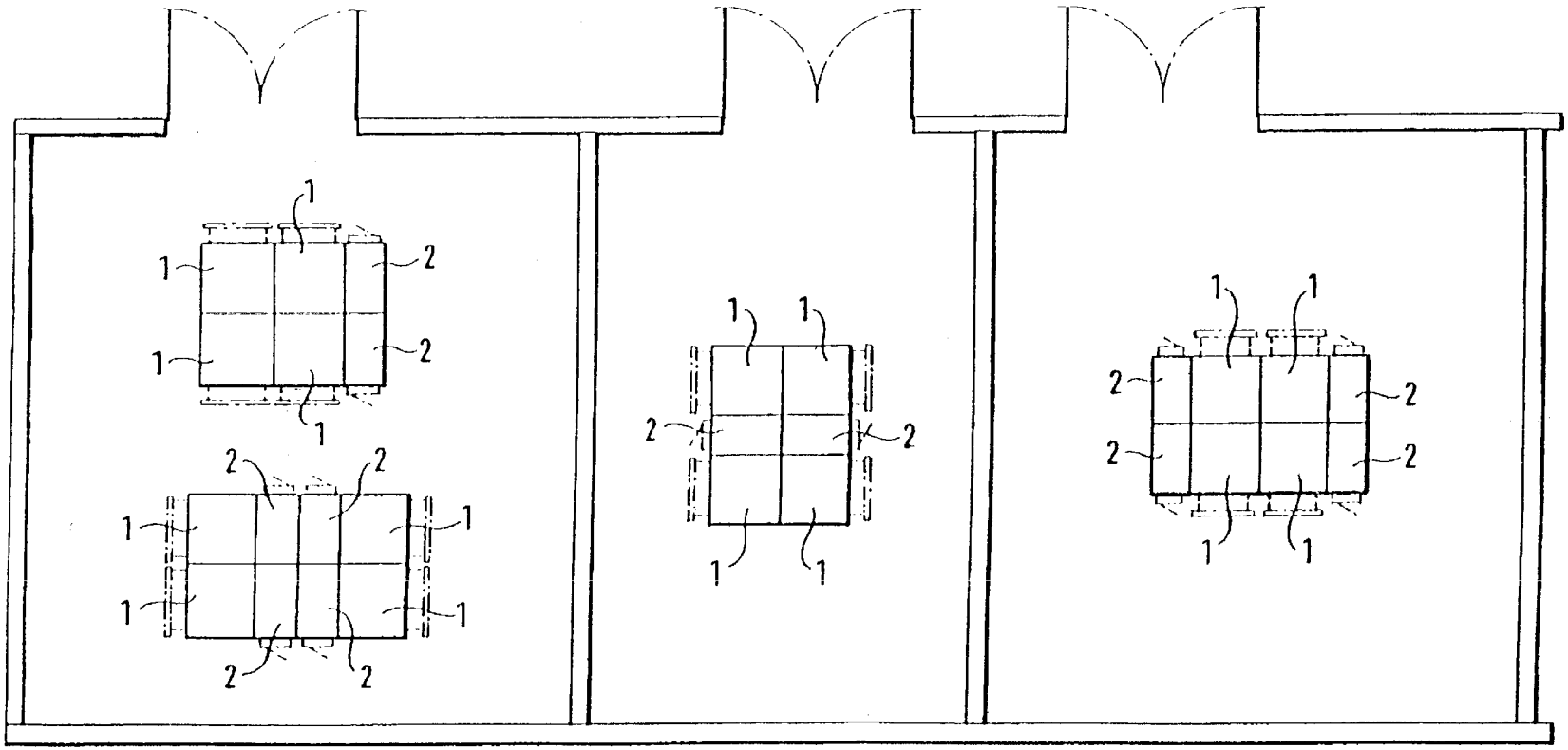

The invention is explained in more detail below by means of an exemplary embodiment illustrated in the drawing, in which:

FIG. 1 shows, in a perspective illustration, and partially exploded, a dispensing appliance for liquids, consisting of two supply modules and of a dispensing module, FIGS. 2*a*)–*d*) shows diagrammatically, in plan, several possibilities for setting up dispensing appliances, and FIG. 3 shows examples of setting-up in a plan view of a building.

The dispensing appliance, illustrated in FIG. 1, for liquids, for example chemicals for semiconductor production, pharmaceutical raw materials or biological media, has two cabinet-like supply modules 1 and a cabinet-like dispensing-module 2 which are connected to one another. In the drawing, the dispensing module 2 is separated merely for the sake of clearer illustration and is illustrated as being at a distance from the middle supply module 1.

The example of this middle supply module 1 shows that each supply module 1 has a pull-out trolley 3 capable of being moved out of the front side. The pull-out trolley 3 has a case trough 4 which is connected to a front plate 5 of the supply module 1.

As is apparent from FIG. 1, at least one, but preferably both side faces 6 of the pull-out trolley 3 are open. The base trough 4 has a roller bed 7, the roller rotation axes of which are arranged in the pull-out direction, that is to say at right angles to the front plate 5.

For loading the supply module 1, a supply container 8, for example, a drum delivered upright or a plurality of smaller casks, can be pushed from the open side face 6 onto the roller bed 7 of the pull-out trolley 3, until the said supply container assumes the position shown in FIG. 1. In the exemplary embodiment illustrated, the lateral orifices of the pull-out trolley 3 are closed by means of flexible lateral curtains 9 which consist of individual vertical strips and which form a splash guard during connection.

The pull-out trolley 3 is provided on its underside with bottom running rollers 10, so that the pull-out trolley 3 can be pulled out of the front side of the supply module 1 in the way illustrated and pushed back again after the supply container 8 has been exchanged.

The supply container 8 received in the supply module 1 is connected via connecting hoses (not illustrated) to a dispensing and metering installation (not illustrated) of the dispensing module 2 which, in the exemplary embodiment illustrated, is attached to the right-hand side wall 11 of the supply module 1.

A window 13 is cut out in each case in the side wall 11 of the supply module 1 and in that side wall 12 of the dispensing module 2 which faces the said side wall, the line connection between the supply container 8 and the dispensing installation of the dispensing module 2 being led through these windows. Maintenance of the installation in the-dispensing module 2 can be carried out, in the assembled state, through these windows 13 after the pull-out trolley 3 has been moved out.

The dispensing module 2 has a pull-out trolley 14 which can be moved out of the front side and the front plate 15 of which is provided with a door 16 which allows access to a dispensing space 17 in the dispensing module 2. After the door 16 has been opened, a bottle to be filled or another container can be introduced into the dispensing module 2 and connected.

A plurality of dispensing installations for various liquids may be provided n the dispensing module 2. It is consequently possible, using a single dispensing module 2, to dispense a plurality of liquids even simultaneously, without a separate dispensing module being necessary for each liquid. A considerable cost saving can therefore be achieved.

The supply modules 1 and the dispensing module 2 are of the same height, so that, after they have been connected, a compact space-saving unit is obtained. Each of the two supply modules 1 has a square plan contour with an edge length a which is equal to the depth t of the dispensing module 2 designed with a rectangular plan contour.

The dispensing module 2 can be connected in various ways to one or more supply modules 1 to form a unitary dispensing appliance. This is illustrated by some typical examples in FIGS. 2*a*)–*d*).

According to FIG. 2*a*, the dispensing [sic] module 1 is connected at its right-hand side wall 11 to the dispensing module 2. According to FIG. 2*b*, in a way corresponding to the illustration in FIG. 1, two supply modules 1 are connected to one another at their side walls facing one another and the middle supply module 1 is connected, as described, at its right-hand side wall 11 to the dispensing module 2.

In the example according to FIG. 2*c*, the supply module 1 is connected at its left-hand side wall 18 to the dispensing module 2. In the example according to FIG. 2*d*, the rear side wall 19 or back wall of the supply module 1 is connected to the dispensing module 2.

In order to have the flexible setting-up possibilities available, it is expedient to provide in each case, in all three side walls 11, 18 and 19 of each supply module 1 and in both side faces of the dispensing module 2, a window which is opened as required.

The different methods illustrated for the connection of supply modules 1 and dispensing modules 2 make it possible, depending on the existing conditions of space, to have different arrangements which, however, are in each case space-saving. For example, a plurality of the dispensing appliances described may be set up in a row next to one another. In addition or instead, it is also possible to combine a plurality of such dispensing appliances in island-like groups, as shown in FIG. 3. At all events, the dispensing module 1 can be attached to the associated supply module 1 in such a way that both modules are easily accessible under the prevailing conditions of space.

What is claimed is:

1. A dispensing appliance for liquids, comprising:

at least one cabinet-like supply module (1) and a cabinet-like dispensing module (2) connectable to the latter and having a dispensing space (17) accessible from a front side of the cabinet-like dispensing module (2), the supply module (1) having a square plan contour with an edge length (a) which is equal to the depth (t) of the dispensing module (2) designed with a rectangular plan contour; a pull-out trolley (3) having two side faces used for exchangeable reception of a supply container (8) and being movable out of the front side of the supply module (1); the pull-out trolley (3) of the supply module (1) having a base trough (4) which is connected to a front plate (5), wherein at least one of the two side faces (6) of the pull-out trolley (3) is open.

2. A dispensing appliance according to claim 1, wherein both side faces (6) of the pull-out trolley (3) are open.

3. A dispensing appliance according to claim 1, wherein the base trough (4) has a roller bed (7), the roller bed having roller rotation axes arranged in the pull-out direction.

4. A dispensing appliance according to claim 1, wherein the pull-out trolley (3) is provided on its underside with bottom running rollers (10).

5. A dispensing appliance according to claim 1, wherein there is more than one supply module (1) and each supply module (2) has three side walls (11, 18 and 19), wherein a window (13) is cut out in each of the side walls (11, 18 and 19); and wherein there is a cut out in each side wall (12) of the dispensing module (2) facing a side wall (11, 18 or 19) of at least one supply module (1).

6. A dispensing appliance according to claim 1, wherein a window (13) is provided in three side walls (11, 18 and 19) of each supply module (1) and in two side faces of the dispensing module (2).

7. A dispensing appliance according to claim 1, wherein the supply module (1) and the dispensing module (2) are of the same height.

8. A dispensing appliance according to claim 1, wherein a dispensing module (2) is connected together with two supply modules (1).

9. A dispensing appliance according to claim 1, wherein a plurality of dispensing installations for various liquids are provided in the dispensing module (1).

10. A dispensing appliance for liquids comprising:

at least two cabinet-like dispensing modules (1) each having three side walls (11, 18 and 19) and an open front; at least one cabinet-like dispensing module (2) having a side wall (12) connectable to one of said three side walls (11, 18 and 19) in at least one of the dispensing modules (1) and having a dispensing space (17) accessible from a front side thereof, the supply module (1) having a square plan contour with an edge length (a) which is equal to the depth (t) of the dispensing module (2) which has a rectangular plan contour; a window 13 being disposed in each side wall (11, 18 and 19) of the supply modules (1) and in a side wall (12) of the dispensing module (2).

11. A dispensing appliance according to claim 10, wherein there is more than one supply module (1) and wherein a window (13) is provided in all three side walls (11, 18 and 19) of each supply module (1) and in both side faces of the dispensing module (2).

12. A dispensing appliance according to claim 10, wherein the supply module (1) and the dispensing module (2) are of the same height.

13. A dispensing appliance according to claim 10, wherein a dispensing module (2) is connected with two supply modules (1).

14. A dispensing appliance according to claim 10, wherein a plurality of dispensing installations for various liquids are provided in the dispensing module (1).

15. A dispensing appliance for liquids comprising:

two cabinet-like supply modules (1) and a single cabinet-like dispensing module (2) connectable to the latter, the dispensing module (1) having a dispensing space (17) accessible from a side thereof, the supply module (1) having a square plan contour with an edge length (a)

which is equal to the depth (t) of the dispensing module (2) which has a rectangular plan contour.

16. A dispensing appliance according to claim 15 wherein the dispensing module (2) has at least one opening (22) facing an opening (13) in a side wall (11) of the first supply module (1) and an opening (13) in a side wall (18) of the second supply module (1) for connection of liquid supply containers (8) to a dispensing space (17) in the dispensing module (2).

17. A dispensing appliance according to claim 16 wherein the supply modules (1) each have a front open side (6) which receive a trolley (3) supporting a liquid supply container (8).

18. A dispensing appliance according to claim 17 wherein the dispensing module (2) includes an open side having the dispensing space (17) therein accessed through a door (16).

* * * * *